United States Patent [19]

Nozaki et al.

[11] 4,200,043

[45] Apr. 29, 1980

[54] PRINTER HAMMER ASSEMBLY

[75] Inventors: Mineo Nozaki; Osamu Asakura; Mitsuaki Seki, all of Tokyo, Japan

[73] Assignee: Canon Kabushiki Kaisha, Tokyo, Japan

[21] Appl. No.: 882,611

[22] Filed: Mar. 1, 1978

Related U.S. Application Data

[63] Continuation of Ser. No. 720,780, Sep. 7, 1976, abandoned, which is a continuation of Ser. No. 565,225, Apr. 4, 1975, abandoned.

[30] Foreign Application Priority Data

Apr. 5, 1974 [JP] Japan ..... 49-39137
Mar. 28, 1975 [JP] Japan ..... 50-37505

[51] Int. Cl.[2] ..... B41J 1/34
[52] U.S. Cl. ..... 101/93.29; 101/93.48
[58] Field of Search .... 101/93.02, 93.29, 93.32–93.34, 101/93.48; 400/157.2

[56] References Cited

U.S. PATENT DOCUMENTS

| | | | |
|---|---|---|---|
| 3,121,131 | 2/1964 | Blume | 101/382 MV X |
| 3,172,352 | 3/1965 | Helms | 101/93.34 |
| 3,266,418 | 8/1966 | Russo | 101/93.34 X |
| 3,643,595 | 2/1972 | Helms et al. | 101/93.34 |
| 3,707,122 | 12/1972 | Cargill | 101/93.34 |
| 3,734,012 | 5/1973 | Huggins | 101/93.16 |
| 3,735,698 | 5/1973 | Lenders et al. | 101/93.29 X |
| 3,780,650 | 12/1973 | Meier | 101/93.48 |
| 3,793,949 | 2/1974 | Rohwedder | 101/110 X |
| 3,805,698 | 4/1974 | Bowers et al. | 101/111 |
| 3,845,850 | 11/1974 | Herr et al. | 400/120 |

FOREIGN PATENT DOCUMENTS

| | | | |
|---|---|---|---|
| 1101026 | 3/1961 | Fed. Rep. of Germany | 101/93.23 |

OTHER PUBLICATIONS

IBM Tech. Disc. Bulletin, V. D. McCarty, vol. 15, No. 3, Aug. 1972, pp. 824–825.
IBM Tech. Disc. Bulletin, R. W. Luoma, vol. 17, No. 1, Jun. 1974, pp. 340–341.

*Primary Examiner*—Paul T. Sewell
*Attorney, Agent, or Firm*—Fitzpatrick, Cella, Harper & Scinto

[57] ABSTRACT

In the printer, each printing hammer is composed of a pair of electroconductive elastic members arranged parallel to the axis of a type drum and is provided with paramagnetic material at its head. The hammer, when not used, is kept pulled in the non-printing position with the paramagnetic material attracted by a permanent magnet to accumulate mechanical energy in the elastic members. When the accumulated energy is discharged by an electromagnet provided at each hammer head including the paramagnetic material, printing operation is executed. Finishing the printing operation, the hammers return quickly to their home positions by the permanent magnet attraction force. A type drum and hammer heads are composed of an organic resilient substance.

17 Claims, 14 Drawing Figures

MAGNETIC ENERGY AND DEMAGNETIZATION CHARACTERISTICS

PRINTER HAMMER ASSEMBLY

This is a continuation of application Ser. No. 720,780, filed Sept. 7, 1976, now abandoned, which in turn is a continuation of application Ser. No. 565,225, filed Apr. 4, 1975, now abandoned.

BACKGROUND OF THE INVENTION

1. Field of the Invention

This invention relates to a small-sized printer suited for use in a desk-top electronic calculator or similar apparatus, and more particularly to an extremely useful small-size printer which is constructed so as to realize a sizable reduction of the number of parts. Low price, easy assembly, minimization of failure rate and repeated stable operations, and no adjustments in the manufacturing process nor any fine adjustments in use are realized.

More specifically, this invention relates to a small-sized printer in which electromagnet means is mounted to each printing hammer. The electromagnet means is composed of a pair of elastic members designed to pass electric current and arranged parallel to the axis of the type wheel, and is so constructed that when no printing occurs the paramagnetic material in said electromagnet means is attracted by a permanent magnet to bend the elastic members so as to store mechanical energy. When printing occurs an electric current sufficient to at least counteract the magnetic field of the permanent magnet is supplied to the electromagnet means to permit a particular hammer or hammers to hit the type wheel. In order to let the hammer return automatically and quickly to its original position without requiring any specific return mechanism, the magnetic field distribution of the permanent magnet is expanded to cover the entire scope of movement of the paramagnetic material in the hammer, or the paramagnetic material itself is moved within the span of the magnetic field.

2. Description of the Prior Art

Many of the heretofore known types of printers are designed for use in high-speed output machines such as large-sized computers, so that such printers are complicated in mechanism and large in size. There is, for example known a printer of the type in which each hammer operating shank is supported by a pair of leaf springs transversely disposed to the axis of the type wheel so that it is normally attracted by first electromagnet means, and in operation, the shank is released by the action of a second electromagnet means within the first electromagnet means to thereby allow printing. This type of printer, however, requires a specific cam mechanism for returning the shank to the home position, resulting in a complicated printer mechanism and high manufacturing cost. The present invention makes unnecessary such specific return mechanism. According to the present invention, in order to allow automatic return of each shank, the second electromagnet means is provided on each printing hammer and also the first magnet means is so arranged that its magnetic field will cover the entire scope of movement of the hammer.

There is also known a printer utilizing the principle of Fleming's left-hand rule by providing a second magnetic field generating means in the hammer assembly. This type of printer however involves fairly high voltage and current demands as it utilizes the interactions of magnetic fields opposed to the force of the return spring, and also the second magnetic field generating means is necessarily enlarged in size. Further, since the printing operation is based on horizontal movement of the shank supported by a pair of leaf springs planted vertical to the axis of the type wheel, a considerable space is required for the hammer assembly and hence size reduction of this type of printer can hardly be achieved by any significant degree. Moreover, the return stroke of the shank builds up a large volume of energy as the restorative force of the pair of leaf springs is added to the repulsive force of the shank, so that a specific buffer mechanism and stopper means are required. Also involved is the problem of difficult assembly as adjustment of the stroke length is indispensable.

SUMMARY OF THE INVENTION

According to the present invention, the first magnet means is so designed as to be able to perform the functions of both the stopper means and the buffer mechanism, and a pair of leaf springs, adapted to serve as the electric current path, are arranged parallel to the axis of the type wheel so that the overall size of the printer can be significantly reduced and the number of parts needed is minimized.

The primary object of the present invention, therefore, is to provide an improved small-sized printer without the above-said problems of the conventional large-sized printers.

It is also an object of the present invention to provide a small-sized printer which can be adapted as a printing device in a desk-top electronic calculator.

Another object of the present invention is to provide a mechanism best suited for a small-sized printer which is low in power consumption and free of malfunctions.

Still another object of the present invention is to provide a small-sized printer of a type using an open magnetic circuit which is small in size and yet capable of performing high-speed printing while providing sufficient energy required for the printing operation.

A further object of the present invention is to provide a printer which is capable of effecting extremely quiet, quick and automatic return of each printing hammer while accumulating printing energy at a high level.

It is also an object of the present invention to provide a printing device which is small in size, has fewer parts than conventional devices, is low in cost and capable of high-speed printing, and which is also extremely easy to adjust during manufacture. It is still another object of the present invention to provide an impact printer in which a type drum and hammer heads are composed of an organic resilient substance so as to reduce nose on printing.

According to the printing device of the present invention, each printing hammer is composed of a pair of electroconductive elastic members arranged parallel to the axis of the type drum and provided with paramagnetic material at its head. Such hammer, when not used, is retained in the non-printing direction as said paramagnetic material is attracted by a permanent magnet. When printing electromagnet means including said paramagnetic material and provided at each hammer head is actuated to practice printing by dint of the mechanical operative force accumulated in the hammer when it was retained. After printing, said electromagnet is deenergized to allow the printing hammer to return quickly and automatically to the home position as the paramagnetic material is again attracted by the permanent magnet.

The present invention is also characterized by the fact that said permanent magnet itself and the organic elastic means attached thereto are designed to play the roles of both stopper and buffer means during the return stroke of each printing hammer, thereby realizing minimization of the number of parts and simplification of the mechanism.

Also, in the present invention, the spring constant of each printing hammer is adjustable to correspond to the attractive force of the permanent magnet, thereby allowing effective utilization of the accumulated printing energy to obtain clear and uniform impressions.

Further, the printing device according to the present invention is capable of double-striking (or printing a three-figure unit defining comma or decimal point and a figure within the period of one rotation of the drum) as each printing hammer can be quickly returned to its original position immediately after printing.

In the embodiments of the present invention, the printing energy is stored in the leaf springs supporting the hammer head which is attracted by a permanent magnet. This force of attracting the hammer head and keeping it at its retracted position is always present whether or not printing is taking place. For releasing the retracted hammer head, there is employed an electromagnet means formed by winding a coil wire on an iron core (which is made of a paramagnetic material) in the hammer. When starting the printing operation, the coil is connected to power to develop in the iron core a reverse magnetic field which is orientated in the direction of counteracting the magnetic flux from the permanent magnet passing the iron core. The printing hammer is actuated by the force accumulated in the leaf springs to hit against the type drum. The voltage applied for this operation may be of a high level such as to produce a reverse magnetic field that counteracts the magnetic flux from the permanent magnet. Preferably, current feed to the coil is continued until the printing hammer contacts the type drum. Since the printing hammer is always held back by the attraction of the permanent magnet, it requires current to form a reverse magnetic field in the iron core during the time when the printing hammer is being moved. But if the time duration of current feed exceeds even slightly the moment of contact of the printing hammer with the type drum, disturbance could be caused in the printed letters as the type drum is rotating at high speed. Therefore, if arrangement is made such that the accumulated energy will be entirely converted into printing energy upon cut-off of current feed when starting the printing operation and that each hammer head will be automatically returned by the attraction of the permanent magnet, it is possible to always accomplish clear and uniform printing. The leaf springs used in the present invention may be of any material and configuration if they can be driven in the non-printing direction by the hammer attraction to accumulate sufficient energy to perform desired printing and also if they have enough operative force to release the energy in opposition to the attractive force of the magnet. Also, if the hammer head mounted with the electromagnet means is molded from plastic or other like material so as to minimize the striking noise, it becomes possible to perform quiet printing and to protect the electromagnet means to prevent shortcircuiting of the coil.

Now the present invention is described in detail by way of an embodiment thereof with reference to the accompanying drawings.

DESCRIPTION OF THE PREFERRED EMBODIMENTS

Figure 1:
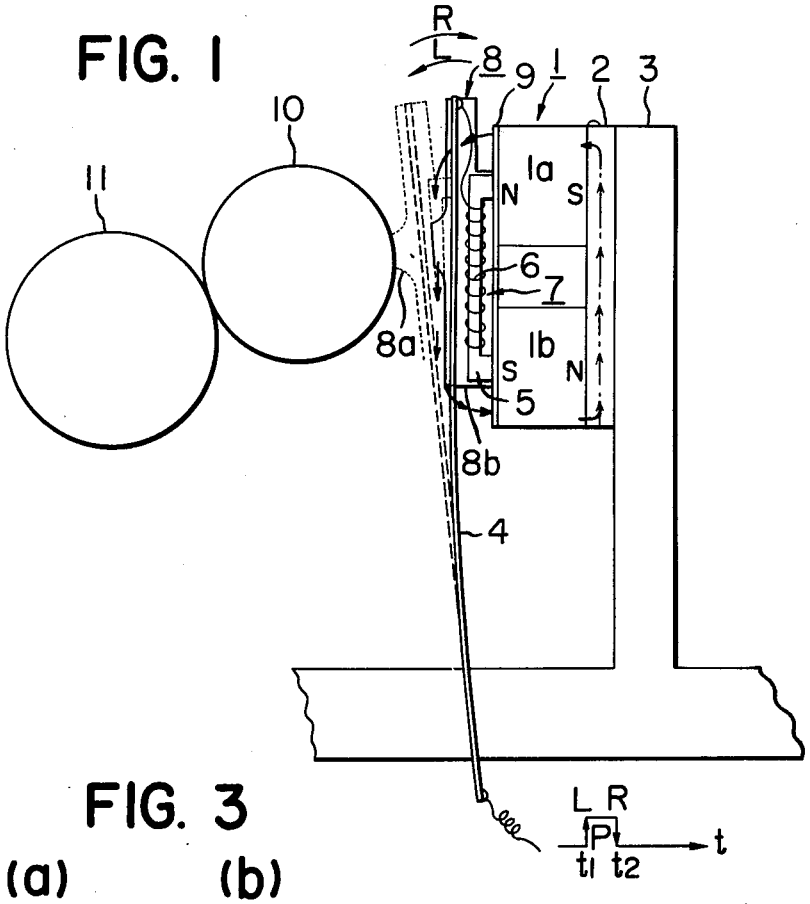
FIG. 1 is a sectional view of one embodiment of the present invention.

Referring first to FIG. 1, reference numeral 1 designates a permanent magnet, 2 a yoke made of a high magnetic permeability material, 3 a supporting member, 4 a pair of leaf springs adapted to accumulate the printing energy in the form of mechanical bias, and 5 an iron core on which a coil 6 is wound to constitute an electromagnet 7. Electric current is fed to the coil 6 through said pair of leaf springs 4. Numeral 8 denotes hammer heads each of which is made of an organic material such as plastic and consists of a type wheel engaging portion 8*a* and an electromagnet covering portion 8*b* with the leaf springs 4 being disposed therebetween, and 9 designates a sound-and vibration-proofing elastic member made of an organic material. The type drum 10 is formed from an organic material such as elastic rubber and arranged to rotate at high speed in contact with the surface of the inking roller 11. The permanent magnet 1 is composed of magnet bars 1*a* and 1*b* which are polarized as shown in the drawing to elevate intensity of the magnetic field. The density of the magnetic flux distribution is increased by the yoke 2. Under the normal condition, the iron core 5 is magnetized and attracted by the magnet 1 to bias the spring 4 in the non-printing direction, thereby accumulating mechanical energy in the springs. When a printing operation starting signal P is applied to a pair of leaf springs 4 at the time $t_1$, an electric current flows to the coil 6 to produce in the iron core 5 a reverse magnetic field which counteracts the magnetic flux from the permanent magnet 1. As the electromagnet 7 in the hammer head 8 is freed from attraction of the magnet 1, the hammer head 8 is made freely movable and hence is driven to describe an arc of a circle toward the type drum 10 by the mechanical energy accumulated in the leaf springs 4, and when said springs 4 have assumed a substantially rectilinear posture, said hammer hits a selected type on the drum to print such type on a recording medium (not shown). When the signal P is cut off at the time $t_2$, the reverse magnetic field from the electromagnet 7 vanishes away, while the electromagnet 7 stays in the magnetic field of the permanent magnet 1 as shown by the dotted chain line in the drawing even in the situation where the head 8 has just hit the type drum 10, so that the iron core 5 in the electromagnet 7 is quickly magnetized and again strongly attracted by the magnet 1 until it abuts against and is stopped by the elastic member 9. As a result, the springs 4 are again biased and kept in a state of stored mechanical energy, thus rapidly and easily restoring the ready position for the next printing operation. The greatest influence for such movement is that the scope of arcuate movement of the iron core 5 is confined within the magnetic field of the permanent magnet 1, this being made possible by adaptation of an open magnetic circuit in the printer mechanism. Most of the conventional types of printers were of a closed magnetic circuit system in which the electromagnet for releasing attraction is fixed to the permanent magnet side. The hammer would move out of the sphere of the magnetic field of the permanent magnet, and hence it was impossible to let the hammer return automatically and certain specific means such as a cam mechanism was required for effecting return of the hammer. According to the present invention, in order to allow automatic return of the hammer, the electromagnet means, which was fixed to the permanent magnet side in the conventional devices, is provided in the hammer head so that it can make circular arc movement with the hammer in the permanent magnetic field.

Usually the magnetic field intensity of the permanent magnet 1 falls off as the inverse square of the distance, so that if the scope of the circular arc movement of the iron core 5 of the electromagnet means 7 in the hammer head 8 becomes too wide, the iron core 5 may move out of the boundary of the magnetic field of the permanent magnet 1 to disable automatic return of the hammer. However, no such problem occurs if said circular arc movement is limited with a certain range and the space between the type drum 10 and the permanent magnet 1 is narrowed. This is a very advantageous matter for the small-sized printer such as proposed in this invention. That is, although it is required in a small-sized printer to maximize the arrangement density of the parts, narrowing of the space between the type drum 10 and magnet 1 is very desirable for realizing reduction of the entire volume size of the apparatus. Thus, if the space between the type drum 10 and the magnet 1 is narrowed, it becomes possible to effect automatic return of the hammer 8, and hence no specific return mechanism such as a cam mechanism is required and the number of parts required is also markedly reduced as the permanent magnet 1 can act both as stopper and as buffer means at the time of return. The present invention has realized marked improvement for reduction of the apparatus size owing to the synergistic effects of these factors. Also, as such reduction of the number of parts spans all types of components such as movable members, friction members and impact members, there are resultantly provided the various technical effects such as noiseless stabilized operation, sharp decrease of failure rate, simplification of manufacture and reduction of manufacturing cost.

Figure 2:
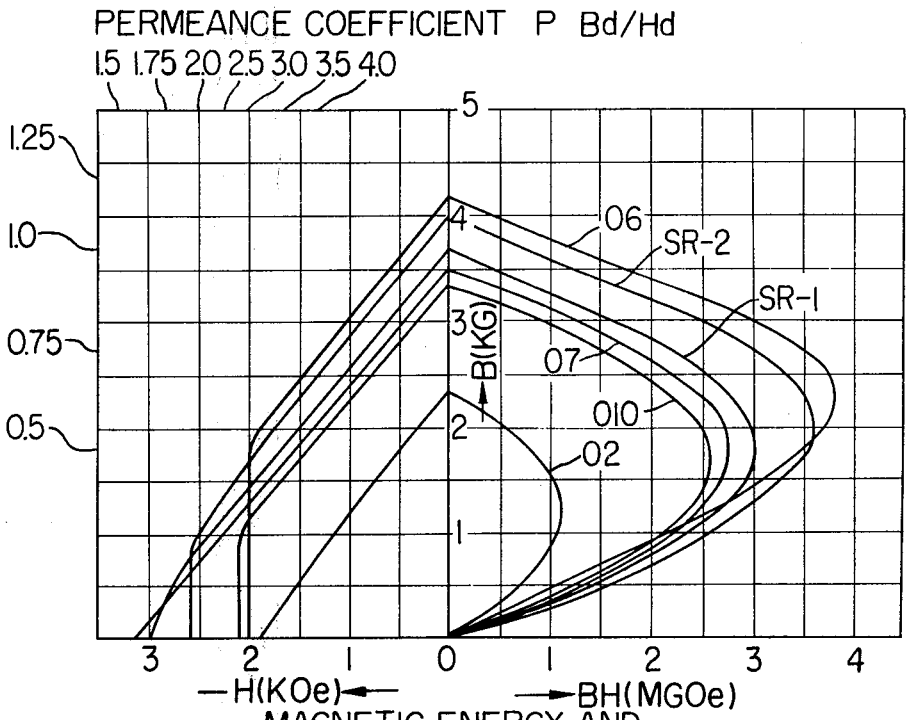
FIG. 2 is a graph showing the magnetic energy and demagnetization characteristics of the permanent magnets used in the present invention.

Regarding the permanent magnet 1, it is apparent that the stronger magnetic field provides better results for obtaining sufficient printing energy and for achieving high speed printing even in a small-sized printer. The present invention uses a material capable of developing an extremely strong magnetic field for the permanent magnet 1. Preferred examples of the permanent magnet material used in the present invention are SR-1 and SR-2 (manufactured by Tohoku Metal Industries Co., Ltd.) and other materials such as shown in the following table and FIG. 2.

Table

Material Standard characteristics

| Material | Classification | Residual magnetic flux density Br(G) | B coercive force $_B$Hc(Oe) | I coercive force $_I$Hc(Oe) | Maximum energy Product BH max (MGOe) | Temperature coefficient of residual magnetisim (reversible) ΔB/B/°C. (%/°C.) |
|---|---|---|---|---|---|---|
| Q2 | barium ferrite (isotropic) | 2200–2400 | 1800–2000 | 3200–3900 | 1.0–1.3 | −0.19 |
| Q6 | barium ferrite (wet anisotropic) | 4000–4300 | 1800–2200 | 1800–2200 | 3.6–4.0 | −0.19 |
| Q7 | barium ferrite (wet anisotropic) | 3300–3700 | 2800–3200 | 3000–3500 | 2.5–3.0 | −0.19 |
| Q10 | barium ferrite (dry anisotropic) | 3300–3700 | 1800–2200 | 1900–2300 | 2.3–2.8 | −0.19 |
| SR-1 | strontium ferrite (wet anisotropic) | 3500–3900 | 2700–3200 | 2800–3500 | 2.6–3.3 | −0.19 |
| SR-2 | strontium ferrite (wet anisotropic) | 3900–4200 | 2400–2800 | 2500–3000 | 3.3–3.8 | −0.19 |

| Material | Temperature coefficient of I coercive force (reversible) ΔH/H/°C. (%/°C.) | Curie temperature Tc(°C.) | Specific gravity d(g/cm$^3$) | Specific resistance ρ(Ω-cm) | Thermal expansion coefficient ΔQ/L/°C. (1c%/°C.) | Uses |
|---|---|---|---|---|---|---|
| Q2 | +0.22 | 450 | 4.9–5.0 | $10^5$ | 1.0–2.0 | motor lead switch |
| Q6 | +0.48 | 450 | 5.0–5.2 | $10^5$ | 1.0–2.0 | speaker |
| Q7 | +0.35 | 450 | 4.5–4.7 | $10^6$ | 1.0–2.0 | electronic machinery |

Table-continued

| Material Standard characteristics | | | | | | |
|---|---|---|---|---|---|---|
| | | | | | | and tools |
| Q10 | +0.42 | 450 | 4.9–5.1 | $10^5$ | 1.0–2.0 | telephone |
| SR-1 | +0.27 | 460 | 4.7–4.9 | $10^5$ | 1.0–2.0 | motor |
| SR-2 | +0.40 | 460 | 4.8–5.0 | $10^5$ | 1.0–2.0 | adsorbing means |

Figure 3:
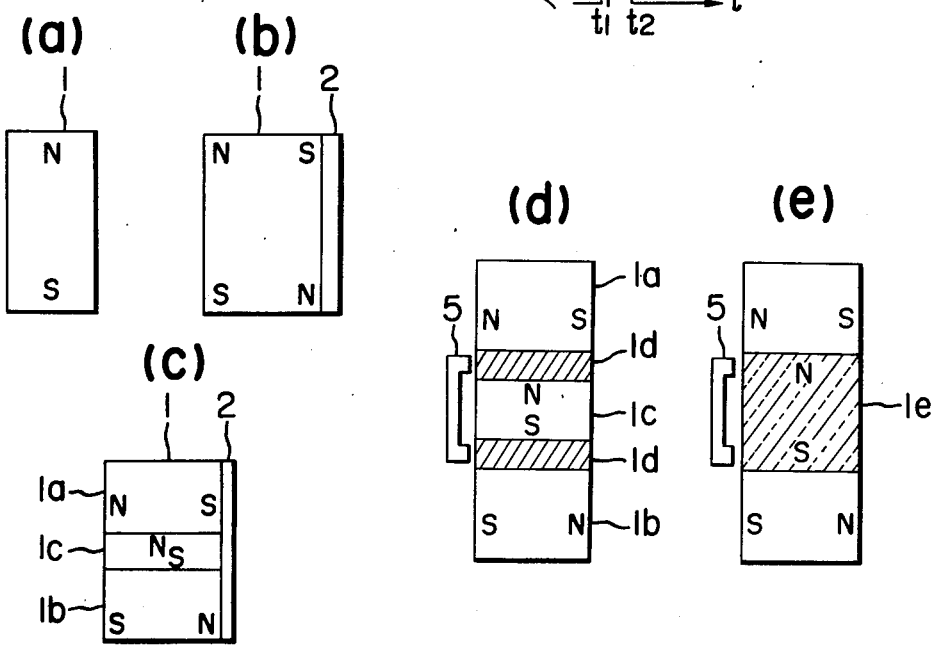
FIG. 3 shows various forms of permanent magnets.

FIG. 3 shows various forms of permanent magnets 1 usable in the present invention. In the figure, (a) shows a usual two-pole (N-S) type magnet, (b) shows a quadrupole (N-S-N-S) type magnet, (c) shows an example where a two-pole bar magnet 1*c* is incorporated in the magnet of (a) to raise the intensity of the magnetic field, (d) is an example where the portions (1*d*) of the magnet where the iron core 5 strikes upon its return trip are comprised of an organic elastic material such as rubber to prevent impact sound and to minimize vibration and wear, with such portions being interposed between the permanent magnets so as not to affect the intensity of the magnetic field. If the portions 1*d* are made of an organic elastic ferromagnetic material which is popularly known as rubber magnet, it serves to prevent demagnetization of the magnetic field produced by the permanent magnets 1*a*, 1*b* and 1*c*. In order to elevate the sound arresting effect at the time of impact, it is advisable to increase the volume of the organic elastic material as shown in (e). Use of a magnetic material is also desirable for minimizing the rate of demagnetization of the permanent magnets. Thus, incorporation of such organic elastic material in the manner shown has the effect of suppressing impact sound even if the hammer return speed is increased, so that this arrangement is most suited for a high speed printing operation. It also proves effective in preventing breakage of the coil 6 on the iron core 5.

Figure 4:
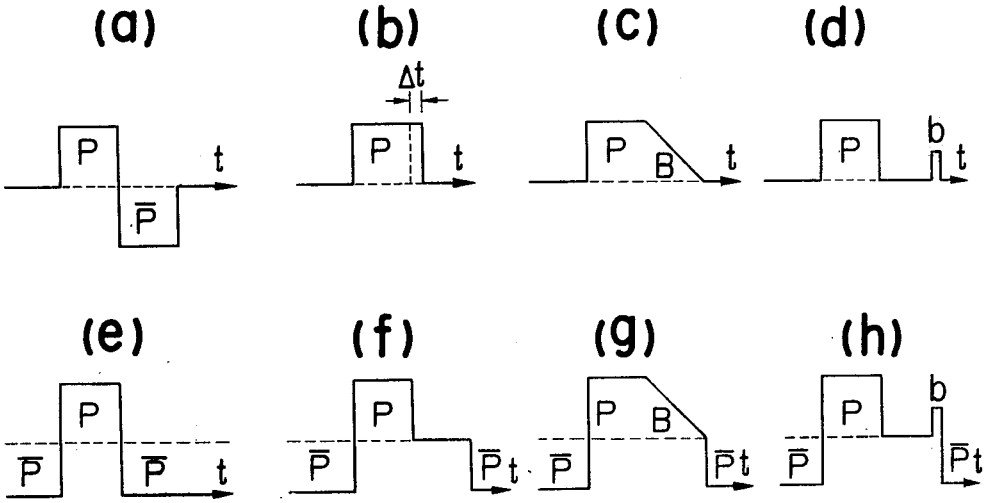
FIG. 4 shows pulses of various wave forms applied to the printing hammer.

With the above-described arrangements of the present invention, it is possible to set the hammer return time and speed at optimal values by considering the current feed to the coil 6 and polarity. For instance, since the attractive force of the magnet 1 alone is acting during the return trip of the hammer 8, the the optimal arrangement can be determined by changing the waveform of the printing signal P in the various ways as shown in FIG. 4. In the figure, (a) shows a wave form suited for an arrangement which provides good sound arresting effect even in high speed return motion as in the case of FIG. 3(*d*) and (*e*). This wave form is therefore adapted for intensifying the magnetic field of the magnet 1 when high speed return is made. FIG. 4(*b*) shows a wave form employed for cancelling as much as possible the repulsion energy at the time of return by keeping the hammer engaged with the type drum for the time $\Delta t$ after the hammer has hit the type drum FIG. 4(*c*) is a wave form suited for effecting quiet return by applying a brake signal B throughout the period of return trip of the hammer, and FIG. 4(*d*) shows an example where a brake signal b is applied immediately before return impact as in the case of FIG. 4(*c*). FIG. 4(*e*) shows a wave form effective for increasing intensity of the magnetic field in case the respective segments of magnet 1 are all made from rubber magnet or such. Normally the hammer 8 is kept attracted to the rubber magnet 1 by dint of the pulse $\overline{P}$, but it flies out upon receiving the pulse P and then returns at high speed and quietly upon receiving the next retaining pulse $\overline{P}$. FIG. 4(*f*) shows an example where, in order to effect even more quiet return than FIG. 4(*e*), the hammer is allowed to make free movement until completion of return but a retaining pulse $\overline{P}$ is applied at the moment of impact. FIG. 4(*g*) is the wave form of the case where a brake signal B is applied for effecting still more quiet return, and FIG. 4(*h*) is an example where FIGS. (*d* ) and (*e*) are combined. Use of pulses of other various wave forms may be considered within the scope of the present invention, and the circuits for practicing said modes of operation can be easily embodied with, if any, slight changes of design which are obvious to those skilled in the art.

In order to facilitate better understanding of the present invention, it is now described in further detail by way of particular embodiments thereof.

Figure 5:
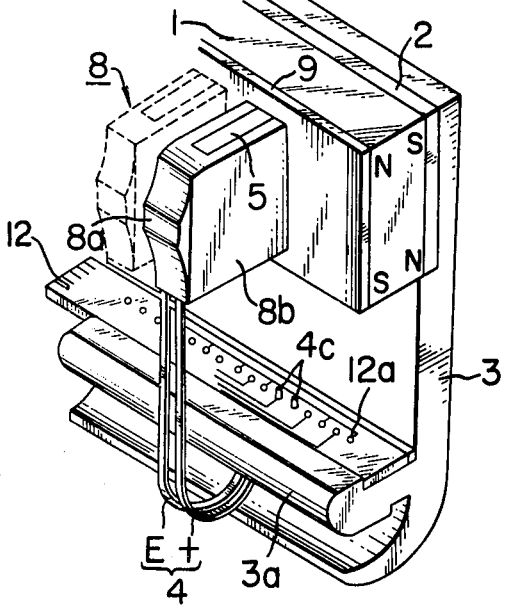
FIG. 5 is a perspective view of another embodiment of the present invention.

FIG. 5 is a further detailed perspective view of the embodiment of FIG. 1. Each printing hammer is composed of the same energy accumulating elements as in the embodiment of FIG. 1, that is, a pair of leaf springs 4, a hammer head 8 having an electromagnet 7 (consisting of an iron core 5 and coil 6) adapted to serve as an attraction releasing means, and a permanent magnet means 1 adapted to give sufficient attraction to accumulate energy. The permanent magnet 1 is formed from a single block and polarized into four poles as shown in the drawing, and a yoke 2 is provided on the side opposite from the hammer head 8, so that the permanent magnet 1 is further intensified in its magnetic force and its magnetic flux passes through the iron core 5 in the hammer head 8. However, in some cases where no yoke 2 is provided, the magnetic flux of the magnet 1 is distributed to a greater distance and return of the hammer head 8 is made quickly and smoothly, so that such yoke is not always required.

The pattern of polarization of the permanent magnet 1 is not limited to that shown in the drawings, but any other pattern may be adopted if it can provide a strong magnetic field that allows energistic passage of the magnetic flux through the iron core 5 within the scope of movement of the hammer head 8. Also, the same object can be accomplished by using an electromagnet in lieu of the permanent magnet if such electromagnet has the same characteristics as the permanent magnet.

Figure 6:
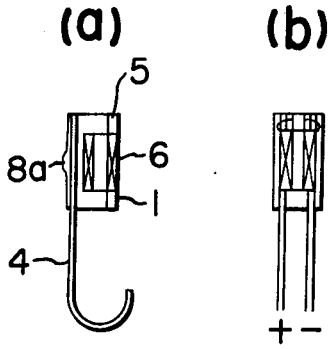
FIGS. 6(*a*) and (*b*) are a sectional view and a plane view, respectively, of a hammer unit in the device of FIG. 5.

As shown in FIGS. 5 and 6, the hammer head 8 is made by molding an iron core 5 and a coil 6 with plastic or other like material while forming a printing portion 8*a* and a cover portion 8*b* of the electromagnet 7 with the same material. Electric current is supplied through a pair of leaf springs 4 so that the lead wire end of the coil 6 will not obstruct movement of the hammer head 8 and will not be broken, and said leaf springs 4 and lead end of the coil 6 are fixed in the head 8. The leaf springs 4 are also so arranged that they will not contact the iron core 5. The ends of the leaf springs 4 are cantilevered by a support block 3 and soldered to a printing plate 12 so as to receive current feed from the outside as shown in FIG. 5.

Figure 7:
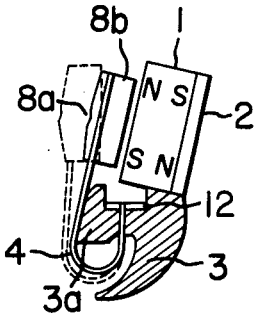
FIG. 7 is a sectional view of the device of FIG. 5.
Figure 8:
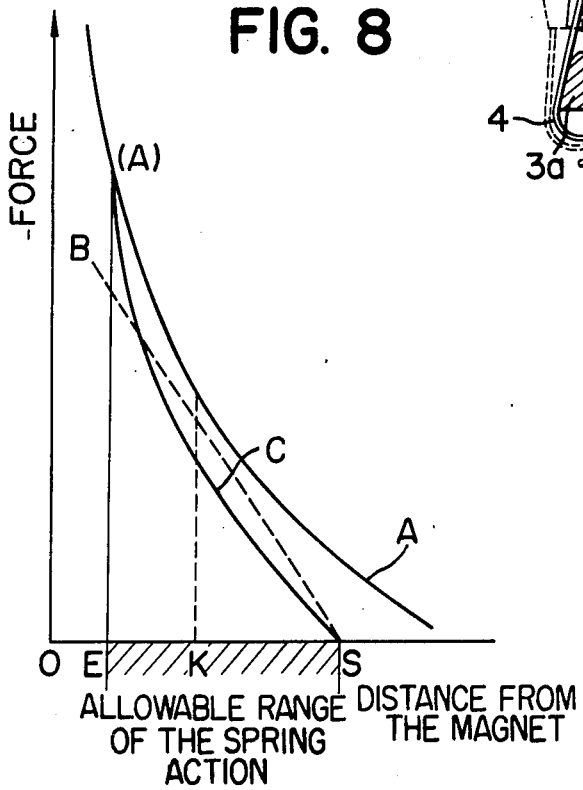
FIG. 8 is a graph showing the relation between the magnetic attraction force and the spring force.

Under the normal condition, that is, when no printing is made, the iron core 5 in the hammer head 8 is attracted by the permanent magnet 1 to keep the leaf springs 4 in a freely bent state as shown in FIG. 7. When a printing order signal is fed to the coil 6 for starting the printing operation, there is produced in the iron core 5 a reverse magnetic field which counteracts the magnetic flux of the permanent magnet 1 to break off attraction of the magnet 1, whereby the hammer head 8 is freed from the magnet and sprung out by the pressing force of the leaf springs 4 to hit the type drum (not shown) to effect printing. In this case, there may be applied a voltage high enough to not only counteract the attractive force of the magnet 1 but also produce a reverse magnetic field which repels the magnet 1 from the iron core 5. Upon cessation of the printing order signal, the reverse magnetic field counteracting the attraction of the magnet 1 disappears, but the iron core 5 in the hammer head 8 still stays within the strong magnetic field of the magnet 1 even at this printing position and hence is again attracted by the magnet 1 to quickly return to its original position. This returning speed is determined by the attractive force of the magnet 1 and spring constant of the springs 4, but as the extremely high speed and quiet return can be effectuated by optimum design, it is possible to drive the hammer head 8 twice during one rotation of the type drum which is rotating at high speed, thus allowing concurrent printing of a figure and a comma or decimal point by such double striking. For accomplishing high speed and clear printing operation, it is necessary to effectively utilize the printing energy, but usually the pressing force of the leaf springs 4 is not analogous to the attractive force of the magnet 1, and hence such energy utilization efficiency is low. Also, the permanent magnet 1 gives to the iron core 5 a restricting force A which is inversely proportional to the square of the distance as shown in FIG. 8. and attracts the integrated hammer head 8 and leaf springs 4. On the other hand, a flat leaf spring has a fixed spring constant which is expressed by a straight line B in FIG. 8. It is an essential requirement for the permanent magnet 1 to attract the hammer head 8 that the curve (A) is always positioned above the straight line (B). It is to be here noted that as apparent from the graph, the difference between the force expressed by curve (A) and that expressed by straight line (B) becomes smallest at a point K in the allowable range of the spring action S-E. This means that the relative force relation is changed at a halfway point when letting off or attracting the hammer head 8, resulting in reduced reliability in performing the full function of the printing apparatus. In order to solve this problem, it is necessary to change the straight line (B) into a curve such as expressed by (C). However, in the case of a flat leaf spring, the spring constant is always fixed and hence expressed by a straight line such as (B), and as far as such straight line is formed, it is inevitable that the smallest value is provided between the straight line and the curve. Therefore, one recommendable measure is to provide a bent portion 3*a* in the support block 3 such that the spring constant will vary in the course of flexure.

According to this arrangement, when the hammer 8 is attracted and stopped by the permanent magnet 1 at the point E, it becomes possible to make the difference between (A) and (C) smaller than the difference between (A) and (B) (or to make such difference zero in some extreme cases) by thus changing the spring constant. This allows reduction of the power requirement of the solenoid 7 and also produces the effect of excessively quickening movement of the hammer head 8. Thus, by stopping hammer head 8 at distance OE from the region of maximum magnetic field, the release of the hammer head 8 is facilitated in that a smaller energizing current for the electromagnet is required than if the hammer head were in contact with the strongest magnetic field region of the permanent magnet 1. Reduction of the power requirement of the solenoid allows independent arrangement of the printing hammers for each column, and this enables phenomenal reduction of the entire size of the apparatus and exercise of high speed printing operation. Also, if the magnet attraction and spring constant are set at suitable values when attracting the hammer, it is possible to return and stop the hammer head without creating any noise. Thus, the bent portion 3*a* of the support block 3 is so shaped as to attract and stop the hammer head 8 without letting it contact with the permanent magnet 1 as shown in FIG. 7. Under this condition, the force of the leaf springs 4 acting toward the type drum and the attractive force of the magnet 1 are balanced, and hence the difference between such forces is zero as shown by point E in FIG. 8. As said above, the pressing force of the leaf springs 4 under this condition can be made greater than the force expressed by the straight line B to make it possible to achieve the quickest possible separation of the hammer head 8 from the magnet 1 when said head is actuated, thus allowing high speed uniform printing. Also, as the spring constant is set by the bent portion 3*a* so as to stop the hammer head 8 without letting it touch the magnet 1 when it returns, extremely quiet return motion is accomplished. It is also possible to arrest impact sound at the time of return by inserting a permeable rubber plate (for example Teflon) 9 in the space between the hammer head and magnet or by forming the permanent magnet 1 from an elastic magnetic material such as a rubber magnet. Such rubber magnet may be inserted between the permanent magnets as discussed before in connection with FIG. 2 (d) and (e).

Figure 9:
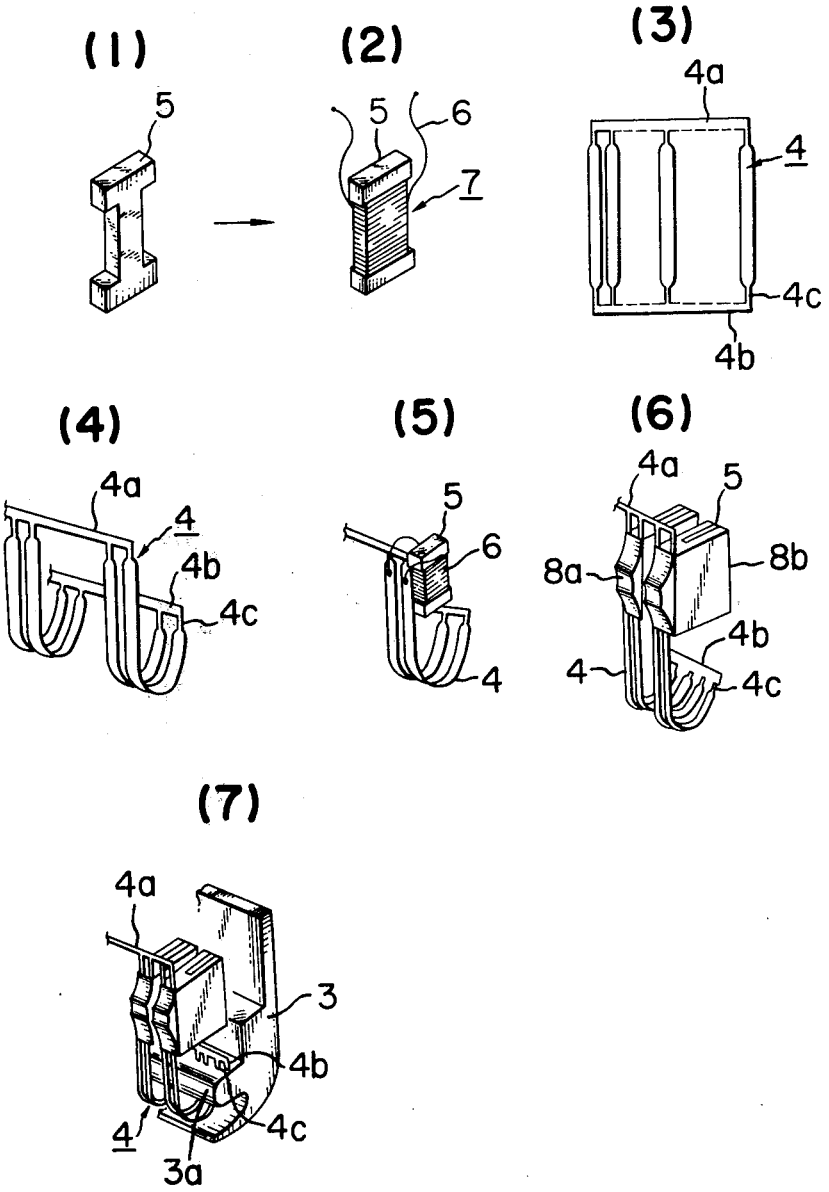
FIG. 9 shows the process of manufacturing the hammer assembly in the device of FIG. 5.

FIG. 9 illustrates a method of producing a printing hammer according to the present invention. First the electromagnets 7 formed each by winding a coil 6 on an iron core 5 are prepared in number the same as the number of printing digits. Then, leaf springs 4 formed in pairs for each digit are pressed all together as shown in FIG.(3), and then bending press is performed for all the digits simultaneously to provide a predetermined curve as shown in (4). Thereafter, both ends of the coil lead of the solenoid shown in (2) are electrically connected to the corresponding pair of leaf springs by spot welding, soldering or other suitable means. This connecting operation may be performed in the manner of one digit after another or all the digits simultaneously. The hammer heads 8 each having a printing portion 8*a* and a cover portion 8*b* of the electromagnet 7 are shaped by injection molding or other types of molding with plastic or such material. This molding of hammer heads can be also accomplished for all the digits simultaneously. If desired, the plastic portions 8*b* and 8*a* may be first shaped separately and joined later.

Then a support block 3 also made of plastic or like material and springs 4 are integrated by injection molding or other method to securely support the printing hammer assembly as shown in (7). This can be accomplished by using various known plastic molding techniques such as insert molding. Then the ends 4*a*, 4*b* of the springs 4 are cut off and the terminal ends 4*c* of the springs 4 are inserted in the spring inserting holes 12*a* in the print base plate 12 and soldered as shown in FIG. 5 to thereby complete the manufacturing process. The curved portion 3*a* of the support block 3 designed for changing the spring constant is formed by plastic molding at a same predetermined curvature for all the digits in the stage shown in FIG. 9(7). Therefore, there is no need of making adjustment to equalize the spring constant for each digit as well as other various adjustments for printing speed, printing density, etc., for each digit. There may be used various means for changing the spring constant, with some preferred examples being shown in FIG. 10.

Figure 10:
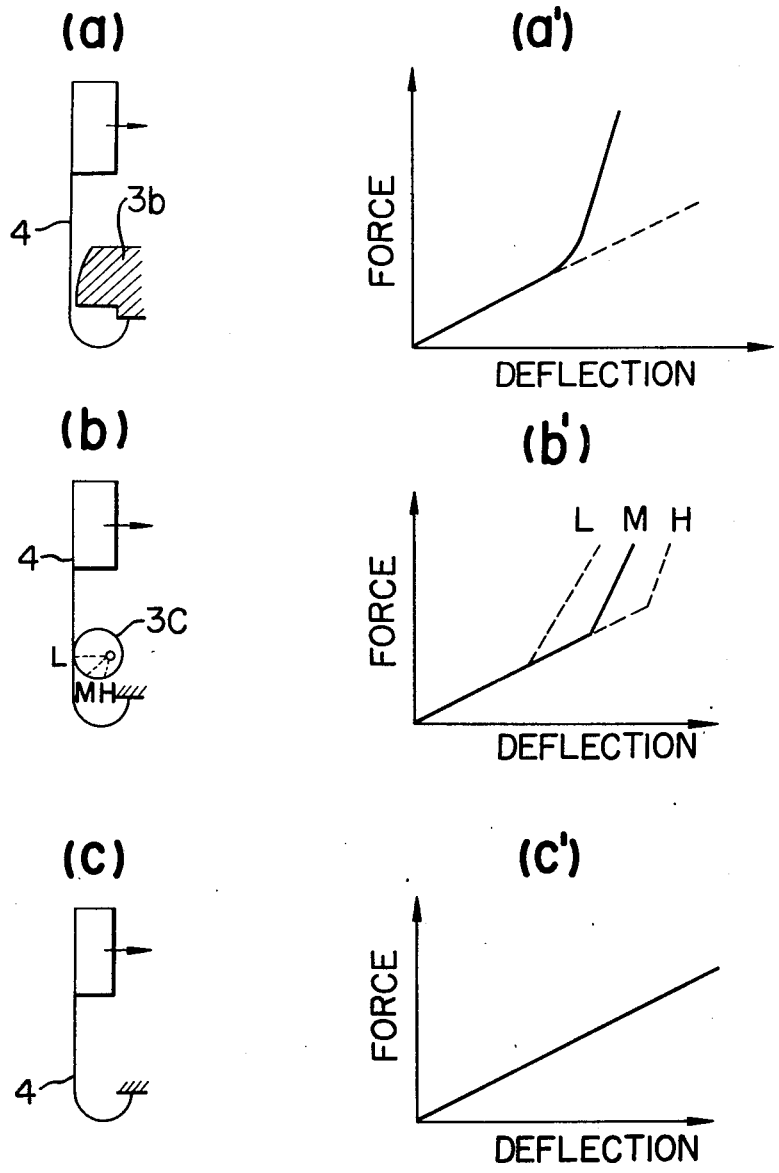
FIG. 10 shows various settings of the relation between magnetic attraction force and spring force.

FIG. 10(*a*) illustrates an example where a curved portion 3*b* having a different curvature from that of the curved portion 3*a* of FIG. 3 is provided. In this case, the rate of change of spring constant is greater than that expressed by curve C in FIG. 8.

FIG. 10(*b*) shows an example where the spring constant is changed by rotating an eccentric cam 3*c*. In this case, when said cam 3*c* is contacted at its one point M with the springs 4, the spring constant is changed at a halfway point as shown by solid line M in FIG. 10(*b'*), and when said cam is contacted at its point H or L with the springs 4, the spring constant changes as shown by broken lines H and L, respectively.

It is thus possible to let the spring constant change at a halfway point by altering the length of the spring portion which actually makes swing motion, so that the optimal design, that is, the optimal setting of the various conditions of printing operation, such as attraction of magnet 1, required printing energy, required printing speed, quiet return stroke, etc., can be accomplished by using said spring constant changing means.

It will be apparent that the spring constant can be also varied while maintaining a set deflection-force relationship such as expressed by a curve as shown in FIG. 8 or FIG. 10(*a'*) or by a straight line as shown in FIG. 10(*b'*), in accordance with various requirements. FIGS. 10(*c*) and (c') illustrate an example where no change of spring constant takes place.

Figure 11:
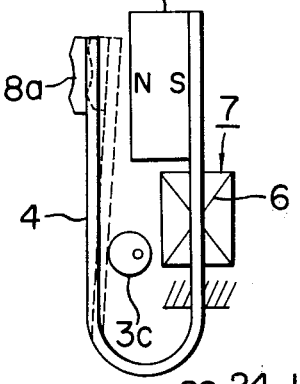
FIG. 11 shows a modification of the embodiment of FIG. 5, where an electromagnet is secured to a stationary portion of each hammer unit.

FIG. 11 shows an embodiment where the magnet attraction releasing means 7 is provided not at the hammer head but at the terminal end of each pair of springs 4 adjacent the magnet 1. In this case, the springs 4 are formed from a magnetic material to form a magnetic path of the magnet 1, and if an electric current is fed to the coil 6 so as to produce a magnetic field orientated contrary to that of the magnet 1, it is possible to let the printing portion 8*a* hit against the type drum by substantially the same operation as in the above-described examples. This embodiment, as compared with that of FIG. 1, is advantageous in precluding damage to the coil and in increasing durability of the assembly as the hammer head portion, which is a movable part, carries no coil and is almost fixed.

Figure 12:
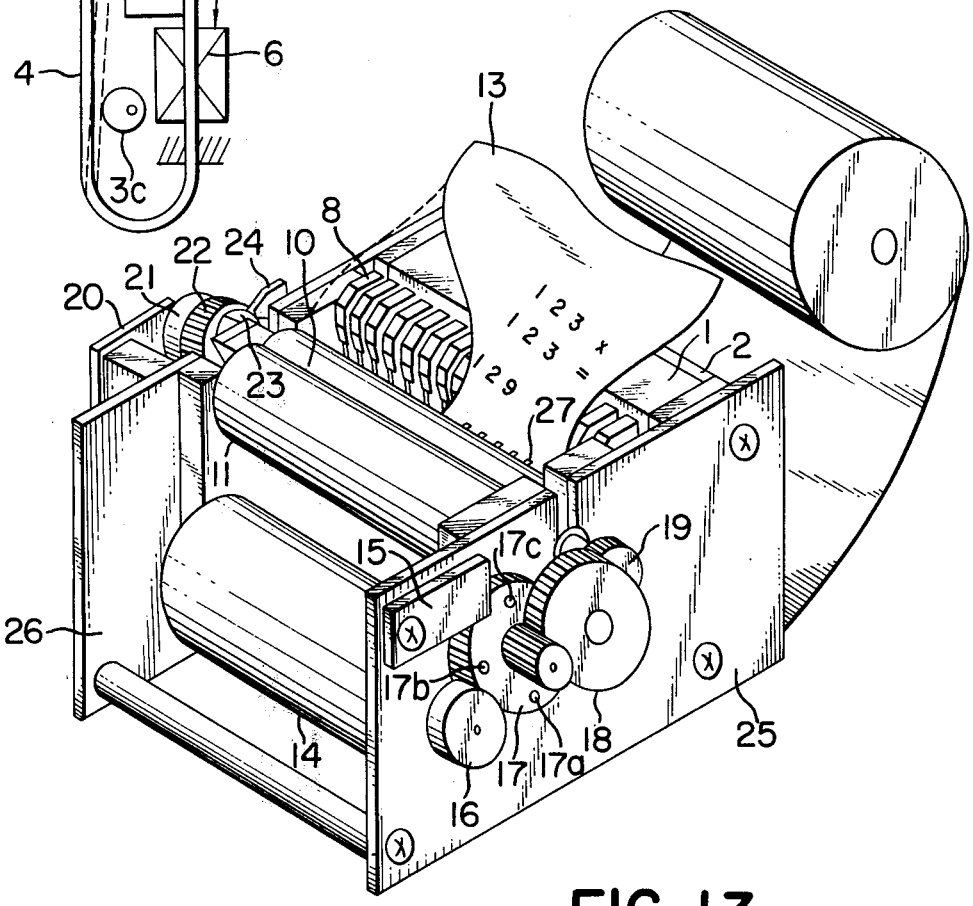
FIG. 12 is a general perspective view of a small-sized printer according to the present invention.

FIG. 12 is a general perspective view of a small-sized printer according to the present invention. As shown in the drawing, the permanent magnet 1, yoke 2 and hammers 8 are assembled into an intergral unit by mold insert. This fits the purpose of making adjustments of parts unnecessary during assembly. The hammer unit consisting of the permanent magnet 1, yoke 2 and hammers 8 is secured in position by side plates 24, 25 so that a printing paper 13 passes between said hammer unit and the type drum 10. An inking roller 11 is disposed in contact with the type drum 10 to supply ink to the drum. There is also provided an ink stain preventing plate 27 adapted to maintain a space between said type drum 10 and the printing paper 13 so that the latter will not be stained with ink when printing is not made.

When a printing order is given and the motor 14 is operated, the gears 16, 17, 18 and 19 are driven to rotate the type drum 10. During this operation, a character pulse CAP is generated by a detector 15 to detect the condition of rotation of the gear 17 which bears the mark 17*a*–17*c* (in the drawing) corresponding to the respective types on the type drum 10. Also, the condition of rotation of the shaft 21 is detected by a detector 20 to control rotation of the type drum 10. Upon completion of the printing operation, the shaft 21 is turned by a lever 24 and ratchet 23, and such turn of the shaft 21 is relayed by a gear 22 to the paper feed mechanism (not shown) to let the paper advance through a length of one digit, allowing the operator to directly check up the printed condition immediately after completion of the printing operation.

Figure 13:
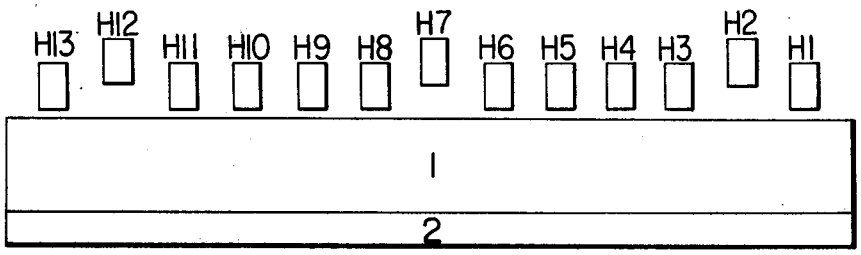
FIG. 13 shows a mode of printing operation in which selected hammers are driven for every fifth digit.

FIG. 13 shows a mode of typing operation in which three (max.) of the 13 side-by-side arranged hammers H1-H13 are driven at one time for every fifth digit. Thus, if the hammers 8 are driven for every fifth digit, it is possible to secure the minimum requirements of printing energy even if the driving voltage (current) for each digit is reduced. This feature is further discussed hereinbelow.

Figure 14:
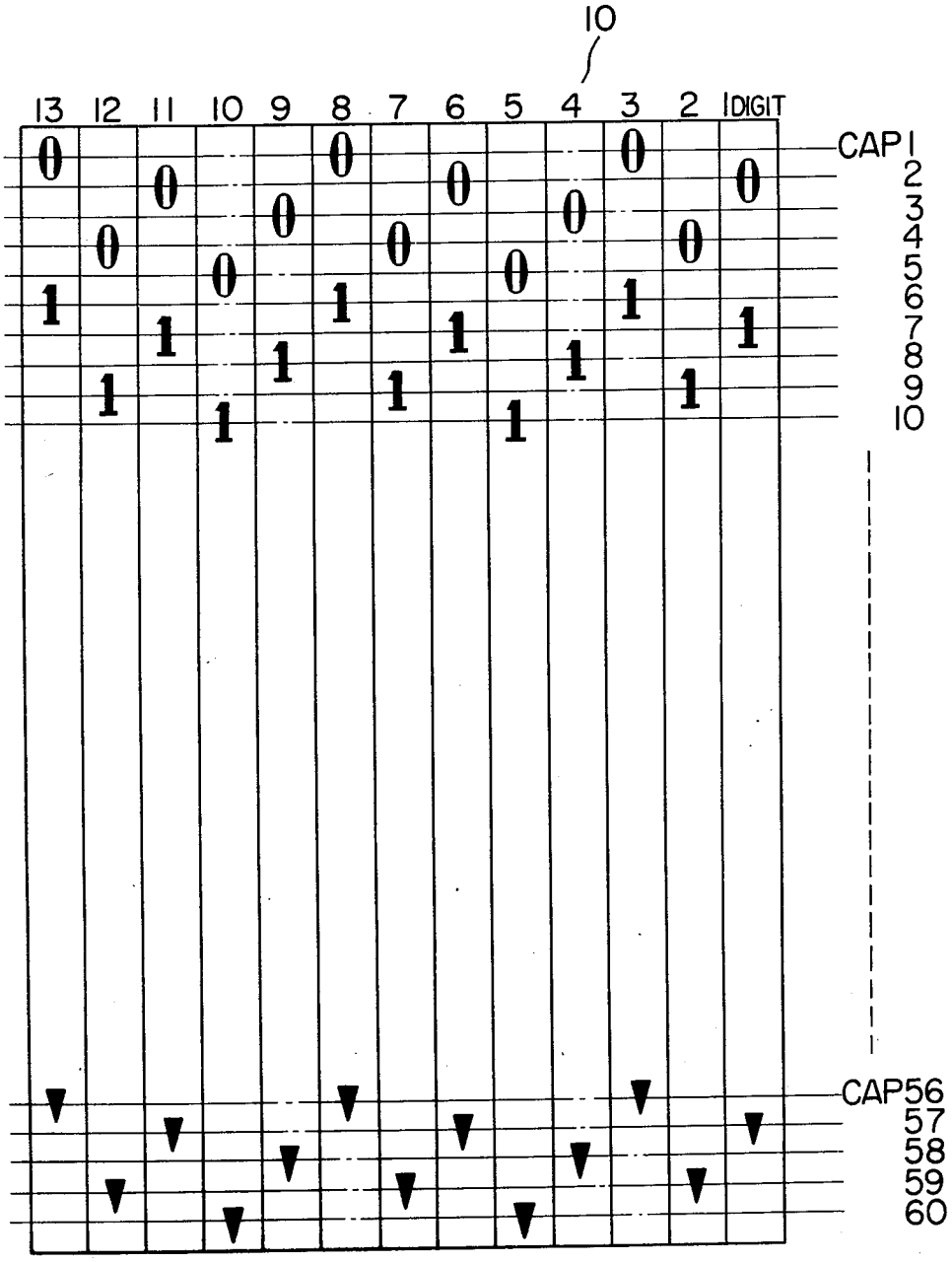
FIG. 14 is an expansion plan of a type drum suited for use in the operating mode of FIG. 13.

The graph of FIG. 8 suggests a relation between magnetic force and size of the iron core. It will be noted that if the size of the iron core is enlarged, the magnetic attraction is correspondingly increased, with the curve A in the graph rising up generally. This graph shows measurement of only one hammer when other iron core is being attracted by the magnet, so if the magnetic attraction is measured under a condition where two hammers H7 and H8 in FIG. 13 are driven simultaneously, the magnetic attraction becomes stronger than when driving only one hammer H7. Therefore, when operating the hammers, if one hammer alone is allowed to move with the other hammers staying stationary, such other hammers being allowed to move after return of said one hammer, any unevenness of printing force is eliminated to provide uniformized printing quality as any of the hammers moves under the same interrelation of force. According to this pattern of operation, the number of hammers moved at one time is reduced and hence, if the simultaneously driven hammers are wide apart (such as five-digit apart) from each other, there can be obtained stabilized relation of force to allow clear printing while reducing the instantaneous current consumption. The voltage required for printing of each digit is also lessened. An example of type drum 10 suited for this hammer driving system is shown in FIG. 14. As noted from the figure, the number of hammers that can be driven at one time is three, for example H3, H8 and H13, and these hammers are apart the interval of five digits from each other, so that the above-said advantages can be provided.

We claim:

1. A printer comprising:

a type member including a plurality of types;

magnetic field producing means spaced from said type member and having one surface for generating a magnetic flux from a first part of said one surface to a second part of said one surface to establish a first magnetic field in an adjacent space;

a hammer movable toward and away from said type member through the space; and electromagnetic means disposed in the space for generating, when energized, a second magnetic field which opposes the first magnetic field in a particular portion of the space so that said hammer moves toward said type member, said electromagnetic means including a magnetic member having a pair of projections and a coil wound on said magnetic member, said pair of projections being respectively opposed to the first and second parts of said one surface of said magnetic field producing means.

2. A printer according to claim 1, wherein the surface of said magnetic field producing means opposite to said one surface contacts a plate of magnetic material.

3. A printer according to claim 1 further comprising a nonmagnetic substance provided on the one surface of said magnetic field producing means.

4. A printer according to claim 3, wherein said nonmagnetic substance comprises an organic elastic material.

5. A printer according to claim 3, wherein said hammer is supported on an elastic member, wherein said hammer and said magnetic field producing means are maintained in an attractive relationship to each other, but spaced by said nonmagnetic substance to store mechanical energy in said elastic member, and wherein, in response to energization of said coil, the mechanical energy stored in said elastic member is released to permit said hammer to move toward said type member.

6. A printer according to claim 1, wherein said magnetic field producing means comprises a permanent magnet.

7. A printer according to claim 6, wherein said permanent magnet comprises elastic ferromagnetic material.

8. A printing comprising:

magnetic field producing means including a permanent magnet for producing a first magnetic field in a space;

a nonmagnetic member provided on said magnetic field producing means, said member comprising organic material; and a hammer movable through the space provided with the first magnetic field and including an electromagnet assembly, wherein said electromagnet assembly comprises a magnetic member having a pair of projections and a coil wound about said magnetic member, wherein said hammer is supported on an elastic member and is attracted by said magnetic field producing means to contact said nonmagnetic member while mechanical energy is stored in said elastic member, and wherein said hammer is spaced from a region defining the strongest magnetic field of said magnetic field producing means by the thickness of said nonmagnetic member.

9. A printer according to claim 8, wherein said elastic member comprises a pair of metal elements through which current is conducted to energize said electromagnet assembly.

10. A printer according to claim 8, wherein said permanent magnet defines a region and wherein said magnetic flux is generated from a first part of the region through said non-magnetic member and the space adjacent the region to a second part of the region to establish the first magnetic field in the space.

11. A printer according to claim 8, wherein said nonmagnetic member comprises organic material which is elastic to absorb the impact of said hammer with said nonmagnetic member.

12. A printer comprising:

a type member including a plurality of types;

a permanent magnet having one plane surface directed toward said type member, said permanent magnet having an N-pole in a first part of said one surface and an S-pole in a second part of said one surface;

a magnetic body provided on the surface opposite to said one surface of said permanent magnet;

a nonmagnetic member comprising organic material, said nonmagnetic member being provided on said one surface of said permanent magnet;

a hammer capable of being attracted by the first magnetic field to contact said nonmagnetic member;

an elastic member for supporting said hammer thereon and for storing mechanical energy therein when said hammer is attracted by said permanent magnet; and electromagnetic means provided on said hammer for interrupting, when energized, the attraction of said permanent magnet and thereby release the mechanical energy stored in said elastic member and cause said hammer to move toward said type member, said electromagnetic means including a magnetic member having a pair of projections and a coil wound about said magnetic member.

13. A printer according to claim 12, wherein said elastic member comprises a pair of metal elements through which current is passed to energize said electromagnetic means.

14. A printer according to claim 12, wherein said plurality of types and said hammer comprise organic material.

15. A printer according to claim 12, wherein said permanent magnet comprises elastic ferromagnetic material.

16. A printer according to claim 12 further comprising a plurality of said hammers, wherein said permanent magnet has a width substantially equal to the combined width of said hammers for simultaneously attracting each of said hammers.

17. A printer according to claim 12, wherein said type member has a substantially cylindrical shape and is rotatable and wherein ink is supplied to said type member from an ink roller in contact therewith.

* * * * *